US006350058B1

(12) United States Patent
Linton

(10) Patent No.: US 6,350,058 B1
(45) Date of Patent: Feb. 26, 2002

(54) PARTIALLY SECURED FOUR FLANGE ZIPPER STRIP FOR TRANSVERSE DIRECTION

(75) Inventor: Basil (Bud) C. Linton, Loganville, GA (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/564,907

(22) Filed: May 4, 2000

(51) Int. Cl.[7] ..... B65D 33/16
(52) U.S. Cl. ..... 383/63; 383/61; 24/585.1
(58) Field of Search ..... 383/61, 63, 203, 383/210, 211; 24/585.1

(56) References Cited

U.S. PATENT DOCUMENTS 4,909,017 A 3/1990 McMahon et al.
5,100,246 A * 3/1992 La Pierre et al. ..... 383/61 X
5,152,613 A * 10/1992 Herrington, Jr. ..... 383/63
5,489,252 A * 2/1996 May ..... 383/63 X
5,551,127 A * 9/1996 May ..... 383/63 X
6,065,872 A * 5/2000 Johnson ..... 383/63

* cited by examiner

*Primary Examiner*—Jes F. Pascua
(74) *Attorney, Agent, or Firm*—Pitnay, Hardin, Kipp & Szuch LLP

(57) ABSTRACT

The zipper includes zipper tape with a narrow band of untreated surface on the leading edges of the flanges that permits the tack sealing of the flanges together by non-continuous sealing bars. This prevents the leading edge of the flanges from curling or flipping up thereby reducing the tendency of a leading edge of a zipper from jamming as the web moves over the collar of a form fill and seal apparatus.

8 Claims, 4 Drawing Sheets

PARTIALLY SECURED FOUR FLANGE ZIPPER STRIP FOR TRANSVERSE DIRECTION

BACKGROUND OF THE INVENTION

1. Field of the Invention

The present invention pertains to the application of zipper strips in the transverse direction. More particularly, the present invention pertains to the use of a narrow band of untreated surface on the leading edges of the flanges that permits the tack sealing of the flanges together by non-continuous sealing bars.

2. Description of the Prior Art

In the prior art, the application of a zipper to a film is taught in such references as U.S. Pat. No. 4,909,017 entitled "Reclosable Bag Material, Method and Apparatus", issued on Mar. 20, 1990 to McMahon et al. However, in a "pinch and pull" configuration, such as is disclosed in U.S. patent application Ser. No. 09/244,519 entitled "Pinch and Pull Open Reclosable Bag and Zipper Therefor", filed on Feb. 4, 1999 for Johnson, there has been a tendency for the leading edge of a zipper to jam as the web moves over the collar. Similar prior art can be found in U.S. patent application Ser. No. 09/393,206 entitled "Transverse Direct Zipper Tape", filed on Sep. 9, 1999 for Malin et al.

OBJECTS AND SUMMARY OF THE INVENTION

It is therefore an object of the present invention to reduce the tendency for a leading edge of a zipper to jam as the web moves over the collar in a form fill and seal (FFS) device.

This and other objects are achieved by removing the heat resistant coating from the leading edge of the base web and likewise from portions of the four legs of a flange zipper strip in a pinch, grip and pull configuration of a form fill and seal (FFS) device. Further, a serrated seal bar is used in the web direction to seal down the leading edge to keep the fourth or top edge of the flange from curling or flipping up, without sealing into the bag. The serrated seal is both a carrier seal and a tack seal that breaks open when the package is opened for use.

DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
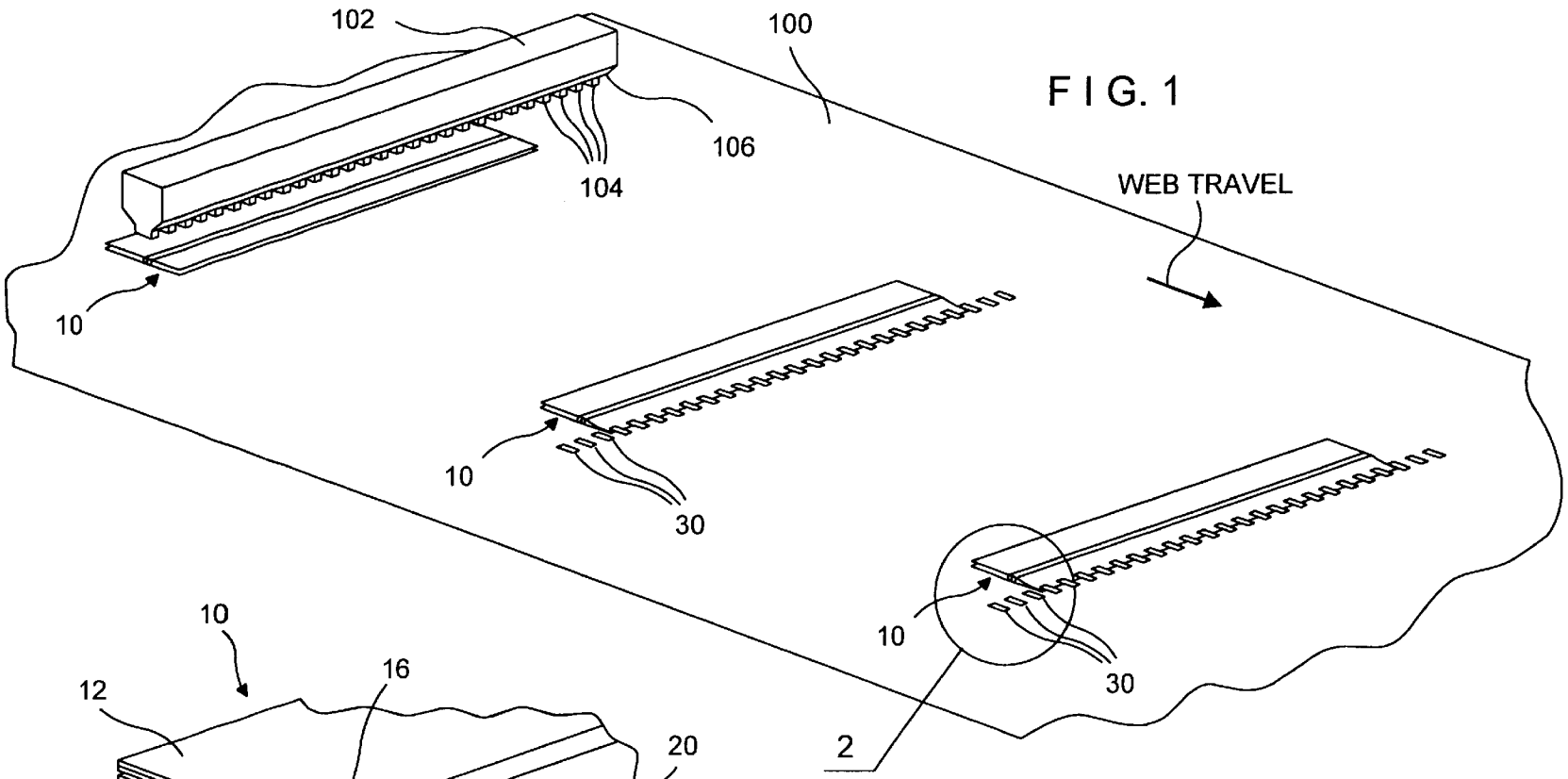
FIG. 1 is a perspective view of the web and how, according to the present invention, the zipper tape is attached to the web.
Figure 2:
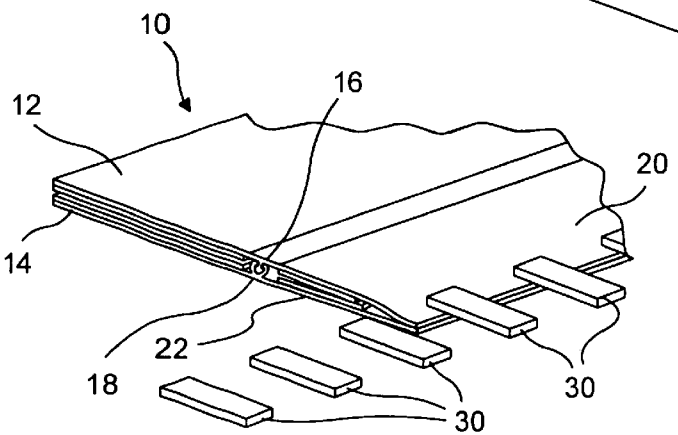
FIG. 2 is a detailed perspective drawing of the tack sealing of the zipper tape to the web, as shown in FIG. 1.
Figure 5:
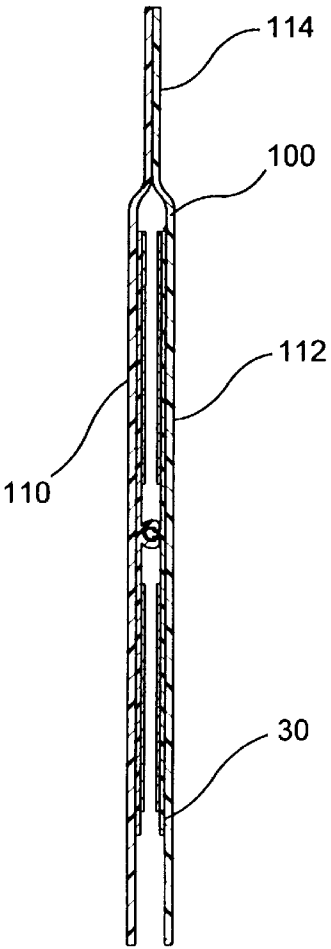
FIG. 5 is a cross-sectional view of the zipper tape section sealed to the web according to the present invention.
Figure 4:
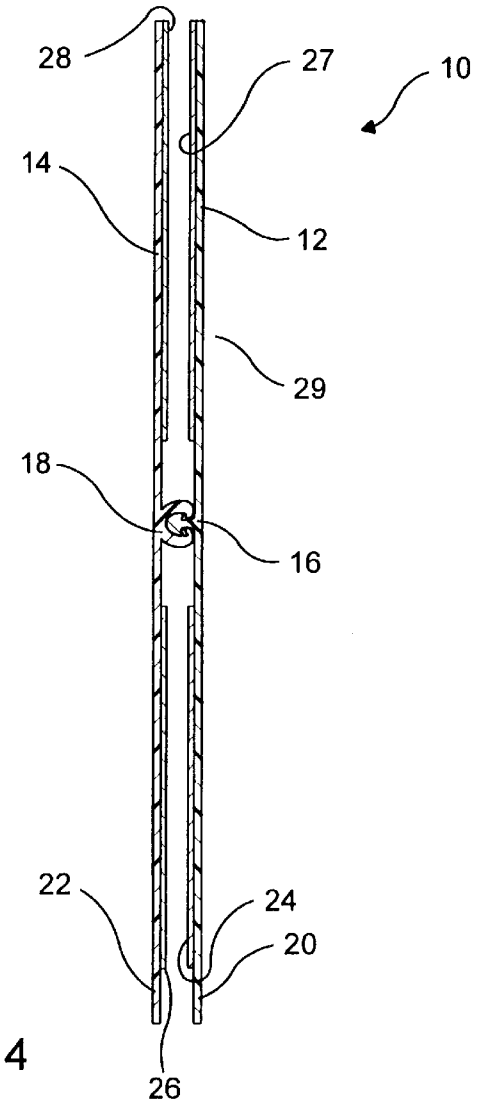
FIG. 4 is a cross-sectional view of the zipper tape section according to the present invention.
Figure 3:
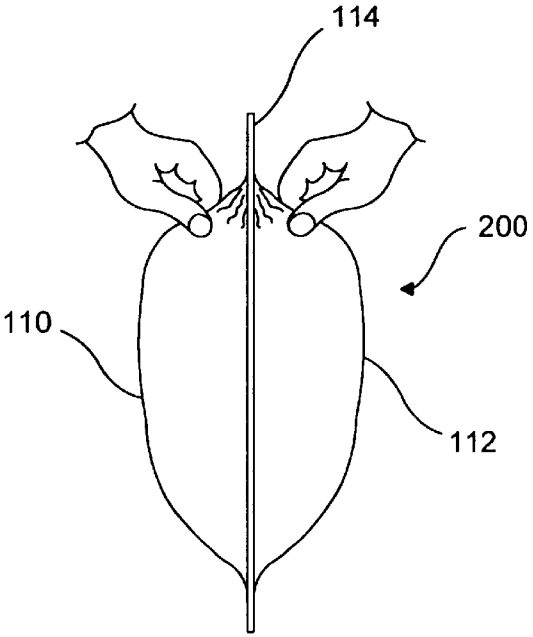
FIG. 3 illustrates a typical opening style of the bag resulting from the present invention.

Referring now to the drawings in detail wherein like numerals indicate like elements throughout the several views, one sees that FIG. 1 is a perspective view of the web 100 and how the zipper tape 10 is attached thereto. Web 100 is a planar sheet and travels in the direction indicated in FIG. 1, generally toward a form fill and seal (FFS) apparatus (not shown). FIG. 2 shows the zipper tape 10 in more detail. Zipper tape 10 includes two halves 12, 14 in a four-flange configuration with respective interlocking zipper profiles 16, 18 (also see FIGS. 4 and 5), and is oriented transverse to the direction of travel of the web 100. As shown in FIG. 4, the leading edges 20, 22 of halves 12, 14 are clear of heat resistant coating and are adjacent to portions 24, 26 of halves 12, 14 which have a heat resistant coating on the inwardly facing sides. Heat resistant coating 27, 28 is likewise on the inwardly facing sides of halves 12, 14 of the portion 29 of zipper tape 10 trailing zipper profiles 16, 18. As shown in FIG. 1, tack sealing bar 102 is transversely oriented with respect to the direction of travel of web 100 and includes downwardly facing tack sealing ribs 104 periodically spaced along lower surface 106 of tack sealing bar 102. Tack sealing ribs 104 are oriented parallel to the direction of travel of web 100 and form tack seals 30 (see FIG. 2) between leading edges 20, 22 of zipper tape 10 and web 100. These tack seals are likewise carrier seals, but typically break when the bag 200 is opened. When the web 100 is cut, folded into sides 110, 112 and sealed to both halves 12, 14 of zipper tape 10 as shown in FIG. 5, with top bag seal 114 formed by sealing side 110 to side 112. This results in the bag 200 as illustrated in FIG. 3, which further illustrates a typical opening style of bag 200.

Figure 7:
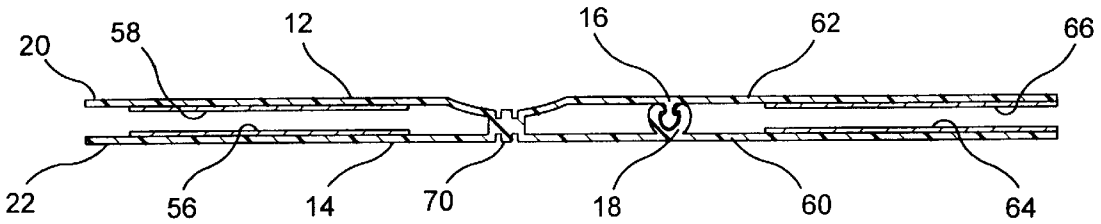
FIG. 7 is a cross-sectional view of a zipper resulting from the zipper tape as cut according to the first aspect of the present invention.
Figure 6:
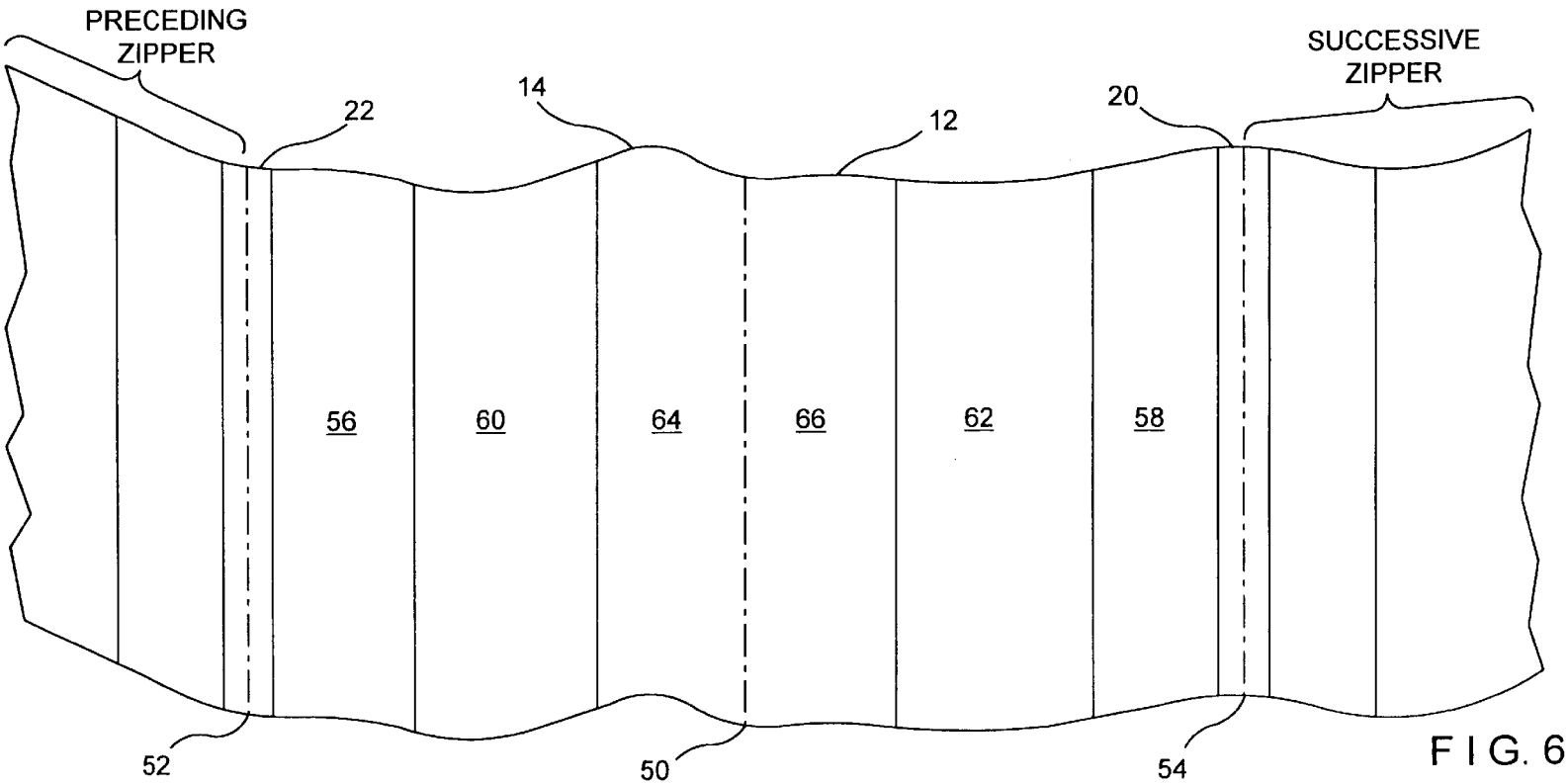
FIG. 6 is a plan view of the zipper tape, showing the cut lines and the spacing of the clear areas and the areas with a heat resistant coating, according to a first aspect of the present invention.

A first aspect of zipper tape 10 is illustrated in FIGS. 6 and 7. Fold cut line 50 separates half 12 from half 14, whereas slitter cut lines 52, 54 separate halves 12, 14 from the zipper tape 10 of preceding or succeeding zippers. Leading edge 22, which is a clear area free of heat resistant coating, is formed immediately adjacent to slitter cut line 52. Likewise, leading edge 20, which is a clear area free of heat resistant coating is formed immediately adjacent to slitter cut line 54. Areas 56, 58, which include the heat resistant coating, are formed adjacent to leading edges 22, 20, respectively. Clear areas 60, 62, which are free of heat resistant coating, are formed adjacent to areas 56, 58. Areas 64, 66 which include the heat resistant coating are formed adjacent to areas 60, 62, and beside each other on opposite sides of fold cut line 50.

Figure 9:
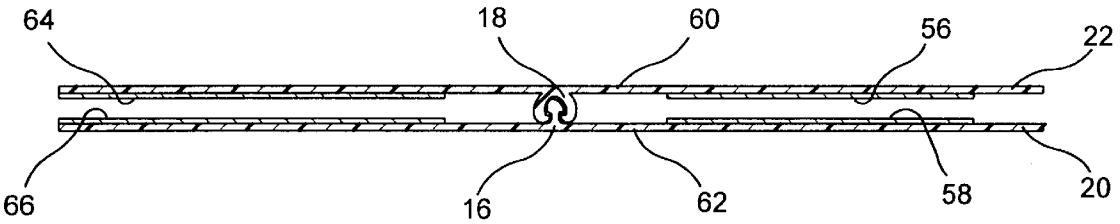
FIG. 9 is a cross-sectional view of a zipper resulting from the zipper tape as cut according to the second aspect of the present invention.
Figure 8:
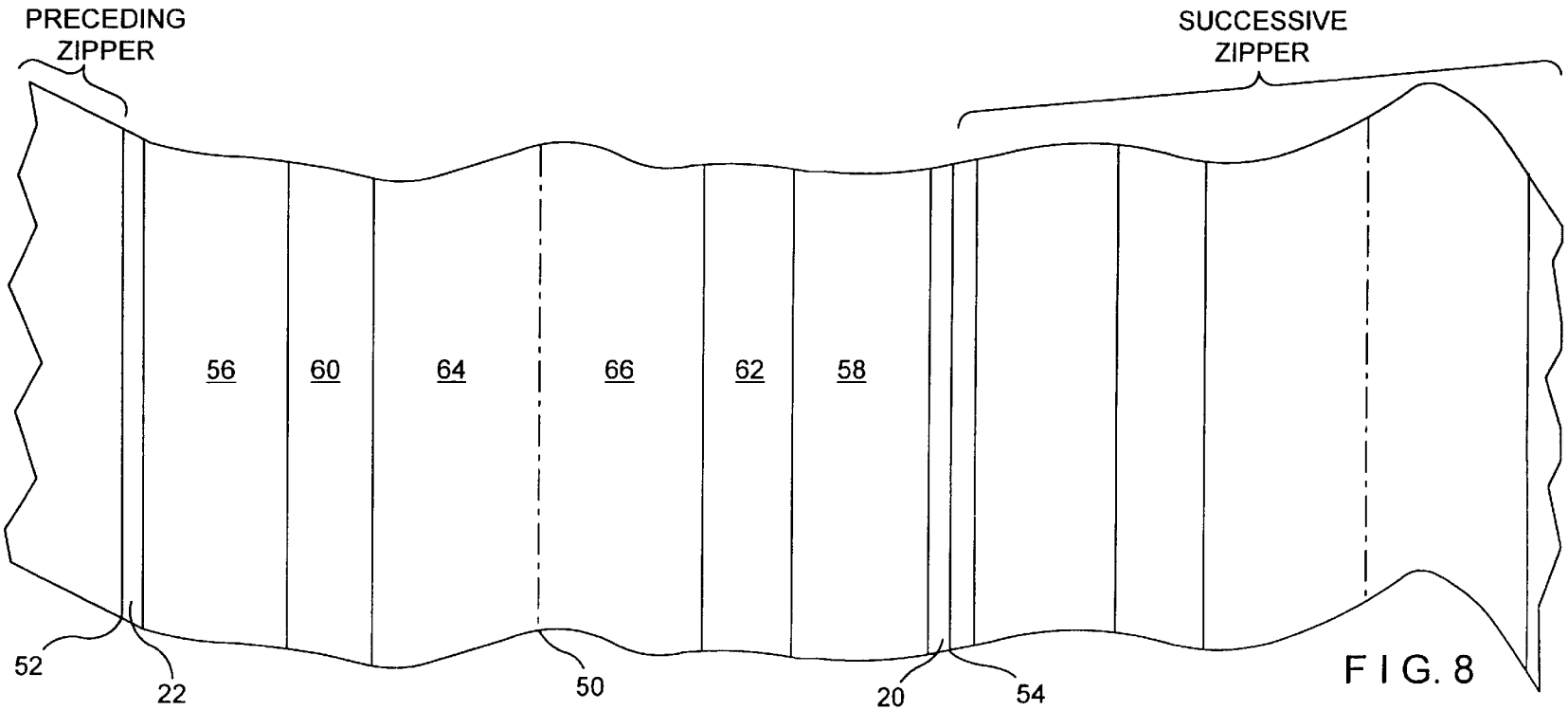
FIG. 8 is plan view of the zipper tape, showing the cut lines and the spacing of the clear areas and the areas with a heat resistant coating, according to a second aspect of the present invention.

As can be seen from FIG. 7, when halves 12, 14 are separated and face each other, leading edges 20, 22 face each other, areas 56, 58 face each other, areas 62, 64 face each other and areas 64, 66 face each other. Additionally, seal 70 is formed between a portion of area 62 and 64 and zipper profiles 16, 18 are formed on a portion of areas 62, 64 respectively, and engage each other. A second aspect of zipper tape 10 with a similar configuration is shown in FIGS. 8 and 9 without the seal 70 and with different proportions to the various areas.

This configuration reduces the tendency of a leading edge of a zipper from jamming as the web moves over the collar of a form fill and seal apparatus (not shown).

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A zipper tape comprising:

a first zipper half facing a second zipper half, said first zipper half having a leading edge and a trailing edge facing a respective leading edge and a respective trailing edge of said second zipper half;

said first zipper half and said second zipper half having facing portions treated with heat resistant coating; and a narrow band free of said heat resistant coating extending rearwardly from the leading edge of each of the zipper halves and wherein a remaining section of said leading edges and said trailing edges of said first half and said second half are treated with said heat resistant coating whereby said facing portions are prevented from being sealed to one another except in the narrow bands where sealing is possible.

2. The zipper tape of claim 1 wherein a central area of said first zipper half faces a central area of said second zipper halves, said central areas each having a respective interlocking profile secured thereto, said interlocking profiles being interlockable to each other.

3. The zipper tape of claim 1 further including a peel seal between said first half and said second half adjacent to said respective interlocking profiles.

4. The zipper tape of claim 1 wherein said leading edges are intermittently sealed to a web.

5. A plastic bag comprising:

a first wall and a second wall, said first wall sealed to said second wall thereby forming, a mouth, said mouth including a zipper tape sealed to said first wall and said second wall for selectively opening and closing said mouth, said zipper tape including:

a first zipper half facing a second zipper half, said first zipper half having a leading edge and a trailing edge facing a respective leading edge and a respective trailing edge of said second zipper half; and said first zipper half and said second zipper half having facing portions treated with heat resistant coating;

a narrow band free of said heat resistant coating extending rearwardly from the leading edge of each of the zipper halves and wherein a remaining section of said leading edges and said trailing edges of said first half and said second half are treated with said heat resistant coating whereby said facing portions are prevented from being sealed to one another except in the narrow bands where sealing is possible.

6. The plastic bag of claim 5 wherein a central area of said first zipper half faces a central area of said second zipper halves, said central areas each having a respective interlocking profile secured thereto, said interlocking profiles being interlockable to each other.

7. The plastic bag of claim 5 further including a seal between said first half and said second half adjacent to said respective interlocking profiles.

8. The plastic bag of claim 5 wherein said leading edges are intermittently sealed to at least one of said first and second walls.

* * * * *